US006243881B1

(12) United States Patent
Brinkman

(10) Patent No.: US 6,243,881 B1
(45) Date of Patent: Jun. 12, 2001

(54) HELMET COVER SYSTEM

(76) Inventor: Brad D. Brinkman, P.O. Box 8151, Medford, OR (US) 97504

( * ) Notice: Subject to any disclaimer, the term of this patent is extended or adjusted under 35 U.S.C. 154(b) by 0 days.

(21) Appl. No.: 09/257,220

(22) Filed: Feb. 25, 1999

(51) Int. Cl.[7] ..... A42B 3/00
(52) U.S. Cl. ..... 2/422; 2/411
(58) Field of Search ..... 2/410, 411, 412, 2/414, 422, 424, 425

(56) References Cited

U.S. PATENT DOCUMENTS

| | | | | |
|---|---|---|---|---|
| 3,242,500 | * | 3/1966 | Derr | 2/410 |
| 3,425,460 | * | 4/1969 | Grant | 2/410 |
| 4,937,888 | * | 7/1990 | Straus | 2/411 |
| 5,421,035 | * | 6/1995 | Klose et al. | 2/411 |
| 5,556,668 | * | 9/1996 | Chun | 427/378 |
| 5,713,082 | * | 2/1998 | Bassette et al. | 2/412 |
| 5,724,681 | * | 3/1998 | Sykes | 2/425 |

* cited by examiner

*Primary Examiner*—Michael A. Neas

(57) ABSTRACT

A helmet cover system for visually enhancing conventional helmets thereby encouraging children to wear helmets. The inventive device includes an outer shell, a support strap attached to the outer shell, and a securing device for securing the outer shell about a conventional helmet. The outer shell preferably has a visually appealing appearance such as a cartoon character, a sport team's helmet, or other desirable shape for children. The outer shell comprises a body, a cavity within the body having a lower opening, a face opening, and a curved member. The cavity is formed to removably receive the conventional helmet and yet be easily worn individually by the child upon their head without discomfort. The body of the outer shell is preferably comprised of injected foam material and painted with a resilient paint for providing a visually stimulating appearance to the child. The securing device is preferably a plurality of pieces of hook and loop fastener attached within the cavity and correspondingly to the conventional helmet, however snap devices may also be utilized to secure the outer shell to the conventional helmet. The curved member provides a motorcycle helmet appearance and also allows the addition of the appearance of a face of a famous character.

10 Claims, 3 Drawing Sheets

HELMET COVER SYSTEM

BACKGROUND OF THE INVENTION

1. Field of the Invention

The present invention relates generally to helmets and more specifically it relates to a helmet cover system for visually enhancing conventional helmets thereby encouraging children to wear helmets.

Conventional helmets for children and adults are designed for lightweight and functionality making them visually unappealing. Children will often remove conventional helmets during an activity such as bicycle riding to avoid undesirable remarks by other children. This is extremely dangerous and increases the likelihood that the child will become injured in an accident. Therefore, there is a need for a device that will encourage children to wear helmets while not interfering with the needed protection of the helmets.

2. Description of the Prior Art

Helmets have been in use for years. Typically, a conventional bicycle helmet will have a high rim portion exposing the ears, unlike a motorcycle helmet, making them visually unappealing. A conventional bicycle helmet usually will have a strap for removably securing to the child's head during utilization. The problem is that many children will remove the conventional bicycle helmets to avoid criticism by other children.

While these devices may be suitable for the particular purpose to which they address, they are not as suitable for visually enhancing conventional helmets thereby encouraging children to wear helmets.

In these respects, the helmet cover system according to the present invention substantially departs from the conventional concepts and designs of the prior art, and in so doing provides an apparatus primarily developed for the purpose of visually enhancing conventional helmets thereby encouraging children to wear helmets.

SUMMARY OF THE INVENTION

In view of the foregoing disadvantages inherent in the known types of helmets now present in the prior art, the present invention provides a new helmet cover system construction wherein the same can be utilized for visually enhancing conventional helmets thereby encouraging children to wear helmets.

The general purpose of the present invention, which will be described subsequently in greater detail, is to provide a new helmet cover system that has many of the advantages of the helmets mentioned heretofore and many novel features that result in a new helmet cover system which is not anticipated, rendered obvious, suggested, or even implied by any of the prior art helmets, either alone or in any combination thereof.

To attain this, the present invention generally comprises an outer shell, a support strap attached to the outer shell, and a securing device for securing the outer shell about a conventional helmet. The outer shell preferably has a visually appealing appearance such as a cartoon character, a sport team's helmet, or other desirable shape for children. The outer shell comprises a body, a cavity within the body having a lower opening, a face opening, and a curved member. The cavity is formed to removably receive the conventional helmet and yet be easily worn individually by the child upon their head without discomfort. The body of the outer shell is preferably comprised of injected foam material and painted with a resilient paint for providing a visually stimulating appearance to the child. The securing device is preferably a plurality of pieces of hook and loop fastener attached within the cavity and correspondingly to the conventional helmet, however snap devices may also be utilized to secure the outer shell to the conventional helmet. The curved member provides a motorcycle helmet appearance and also allows the addition of the appearance of a face of a famous character.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a helmet cover system that will overcome the shortcomings of the prior art devices.

Another object is to provide a helmet cover system that increases the visual appearance of a conventional helmet.

An additional object is to provide a helmet cover system that encourages children to wear their helmets.

A further object is to provide a helmet cover system that is removably attachable to a conventional helmet without requiring significant alteration to the conventional helmet.

Another object is to provide a helmet cover system that does not interfere with the proper utilization of a conventional helmet.

An additional object is to provide a helmet cover system that may be removed from a conventional helmet and worn by the child as a novelty item during play.

A further object is to provide a helmet cover system that floats upon water during utilization in a swimming pool or lake.

Another object is to provide a helmet cover system that simulates a child's favorite sports team, cartoon characters, sports and holidays.

A further object is to provide a helmet cover system that may be reduced in size comparable to a bicycle helmet for utilization by children as a toy.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
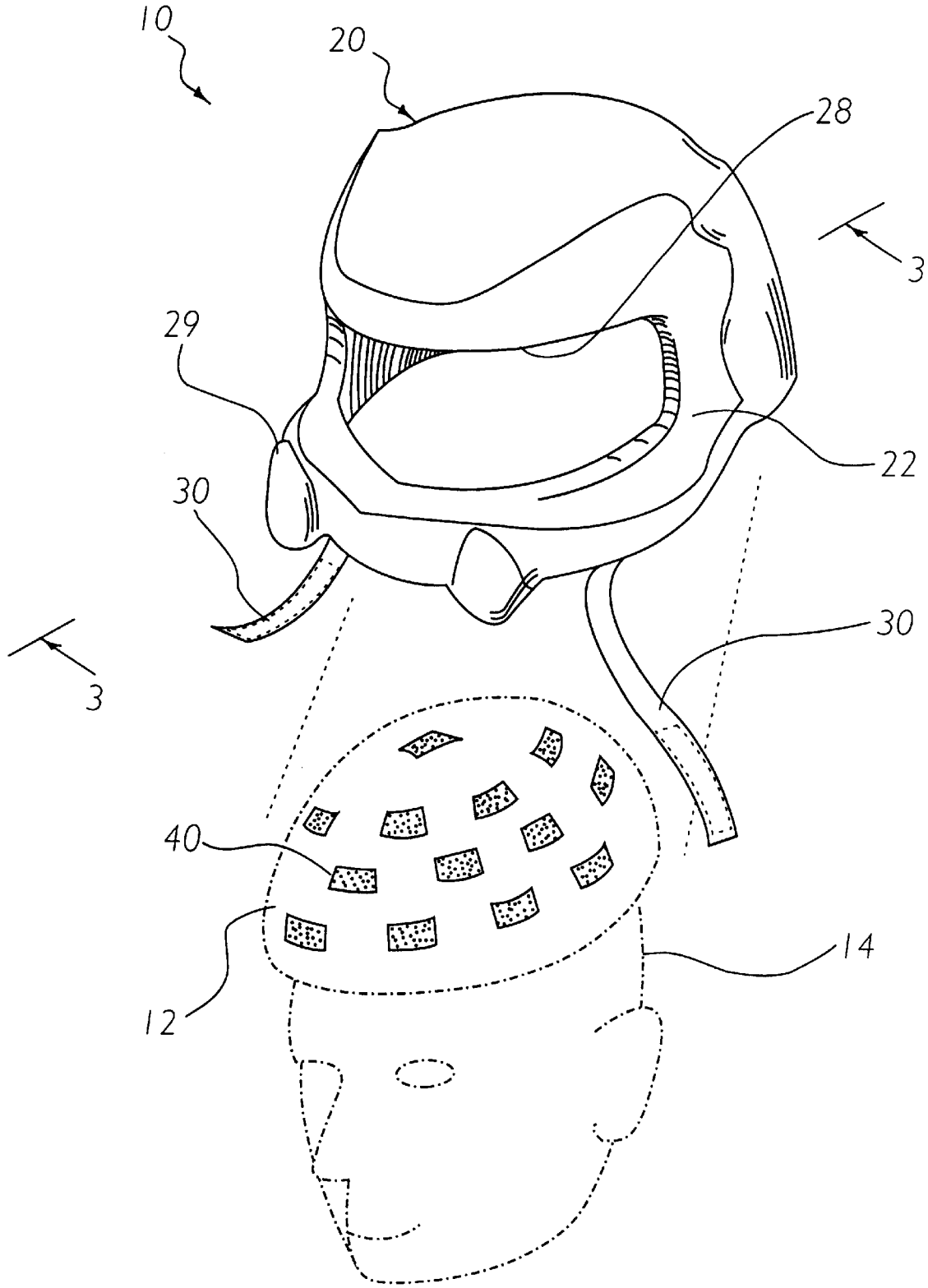
FIG. 1 is an upper perspective view of the present invention positioned above a conventional bicycle helmet.
Figure 2:
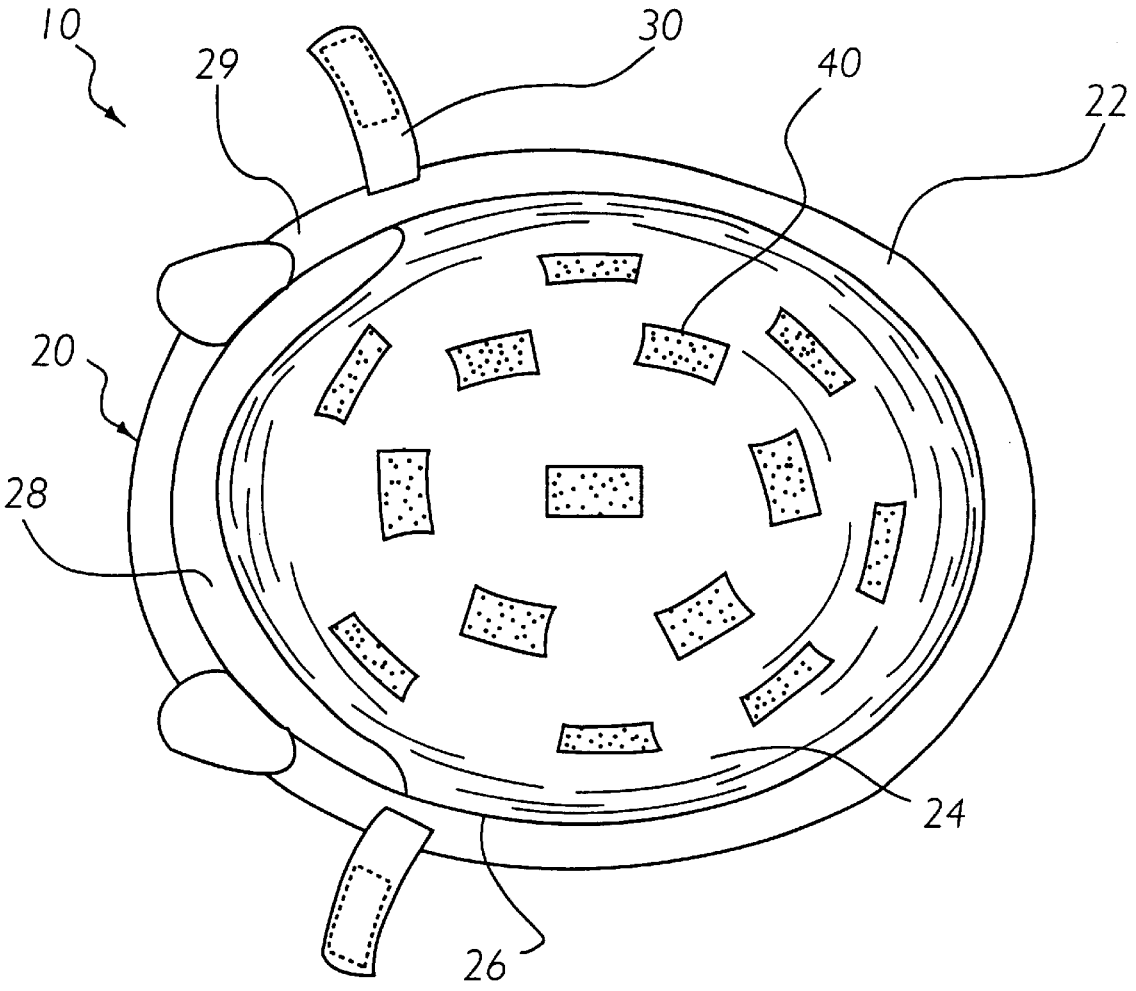
FIG. 2 is a bottom view of the present invention disclosing the hook and loop fasteners within.
Figure 3:
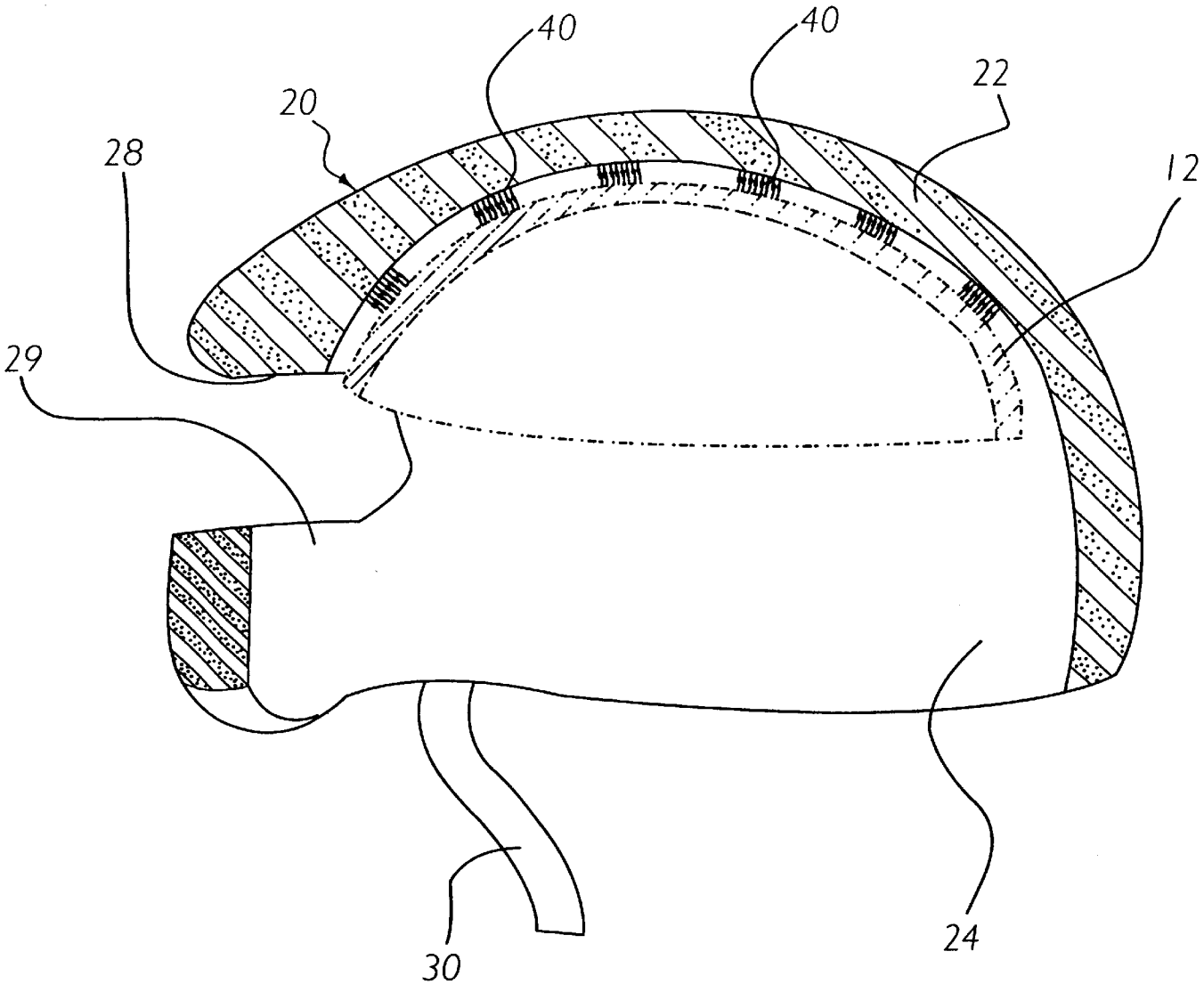
FIG. 3 is a cross-sectional view taken along line 3—3 of FIG. 1.

Turning now descriptively to the drawings, in which similar reference characters denote similar elements throughout the several view, FIGS. 1 through 3 illustrate a helmet cover system 10, which comprises an outer shell 20, a pair of support straps 30 attached to the outer shell 20, and a securing device 40 for securing the outer shell 20 about a conventional helmet 12. The outer shell 20 preferably has a visually appealing appearance such as a cartoon character, a sport team's helmet, or other desirable shape for children. The outer shell 20 comprises a body 22, a cavity 24 within the body 22 having a lower opening 26, a face opening 28, and a curved member 29. The cavity 24 is formed to removably receive the conventional helmet 12 and yet be easily worn individually by the child upon their head 14 without discomfort. The body 22 of the outer shell 20 is preferably comprised of injected foam material and painted with a resilient paint for providing a visually stimulating appearance to the child. The securing device is preferably a plurality of pieces of hook and loop fastener 40 attached within the cavity 24 and correspondingly to the conventional helmet 12, however snap devices may also be utilized to secure the outer shell 20 to the conventional helmet 12. The curved member 29 provides a motorcycle helmet appearance and also allows the addition of the appearance of a face of a famous character.

As shown in FIG. 1 of the drawings, the outer shell 20 preferably has a unique and desirable shape. Possible "themes" for the appearance of the outer shell 20 include, but are not limited to, football, baseball, hockey, racing (cars, boats, motorcycles), airplanes, holiday themes (Halloween, Christmas, Valentines Day, etc.), water sports, karate, soccer, cartoon characters, athletes, medical, movies and other themes.

The outer shell 20 is preferably constructed utilizing a convention foam injection process thereby making the outer shell 20 resilient, soft and buoyant. The outer shell 20 is preferably constructed of a conventional foam rubber material, however any other well-known resilient material may be utilized. The outer shell 20 is preferably painted with a conventional high gloss rubberized paint in various designs to achieve the desired appearance of a character or sports helmet.

As shown in FIGS. 1 through 3 of the drawings, the outer shell 20 includes a body 22, a cavity 24 within the body 22 having a lower opening 26, a face opening 28, and a curved member 29. The lower opening 26 is large enough to receive the head 14 of a child and to receive a conventional helmet 12 as shown in FIG. 1 of the drawings.

As shown in FIGS. 2 and 3 of the drawings, the cavity 24 has a generally spherical shape for conforming to the child's head 14 or conventional helmet 12. Even though not required, a curved member 29 is preferably attached to a lower portion of the body 22 substantially parallel to the lower opening 26 thereby defining the face opening 28. As shown in FIG. 1 of the drawings, the face opening 28 is large enough to avoid interference with the conventional helmet 12 or the vision of the child.

As shown in FIGS. 1 through 3, a pair of support straps 30 are preferably secured to opposing sides of the outer shell 20 adjacent the lower opening 26. The pair of support straps 30 are securable to one another below a chin of the child's head 14 by a conventional securing means such as hook and loop fastener 40 or buckles.

As shown in FIGS. 1 through 3, a plurality of pieces of hook and loop fastener 40 are preferably attached to the interior surface of the cavity 24 of the outer shell 20. A corresponding plurality of pieces of hook and loop fastener 40 are preferably attached to the conventional helmet 12 for removably attaching the outer shell 20 about the conventional helmet 12 as shown in FIG. 1 of the drawings.

In use, the user secures the opposing sides of each of the plurality of hook and loop fasteners 40 together and removes an adhesive cover of each. The user then secures the plurality of hook and loop fasteners 40 within the cavity 24 of the outer shell 20 as shown in FIG. 2 or about the exterior surface of the conventional helmet 12. The user then removes the opposing adhesive cover of each hook and loop fasteners 40 and then positions the outer shell 20 about the conventional helmet 12 thereby aligning and securing the hook and loop fasteners 40 to the cavity 24 of the outer shell 20 and the exterior surface of the conventional helmet 12. The child then secures the conventional helmet 12 to their head 14 as usual except they now have a visually appealing outer shell 20 attached thereto. The pair of support straps 30 may also be secured about the chin of the child during use. If the child desires to utilize the outer shell 20 without the conventional helmet 12, the child simply removes the outer shell 20 from the conventional helmet 12 thereby allowing them to utilize the outer shell 20 individually with the pair of support straps 30 during play.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A helmet cover system comprising:

an outer shell having a visually appealing appearance;

a lower opening within said outer shell;

a face opening within said outer shell and connected to said lower opening;

a curved member attached to said outer shell extending between said lower opening and said face opening;

a cavity within said outer shell connected to said lower opening formed for receiving a conventional helmet; and a securing means for removably securing said outer shell to said conventional helmet.

2. The helmet cover system of claim 1, wherein said securing means comprises a plurality of hook and loop fasteners securable to an exterior surface of said conventional helmet and correspondingly to an interior surface of said cavity of said outer shell.

3. The helmet cover system of claim 2, including:

a pair of support straps secured to opposing sides of said outer shell; and a connecting means for removably securing said pair of support straps to a chin of a child.

4. The helmet cover system of claim 3, wherein said outer shell is comprised of a foam rubber.

5. The helmet cover system of claim 4, wherein said outer shell includes at least one layer of rubberized paint creating a visually appealing design.

6. The helmet cover system of claim 5, wherein said visually appealing design is of a character.

7. The helmet cover system of claim 1, wherein said securing means comprises a plurality of snap devices securable to an exterior surface of said conventional helmet and correspondingly to an interior surface of said cavity of said outer shell.

8. The helmet cover system of claim 7, including:

a pair of support straps secured to opposing sides of said outer shell; and a connecting means for removably securing said pair of support straps to a chin of a child.

9. The helmet cover system of claim 8, wherein said outer shell is comprised of a foam rubber.

10. The helmet cover system of claim 9, wherein said outer shell includes at least one layer of rubberized paint creating a visually appealing design.

* * * * *